US006419583B1

(12) United States Patent
Crumby et al.

(10) Patent No.: US 6,419,583 B1
(45) Date of Patent: Jul. 16, 2002

(54) LARGE PRIZE CENTRAL MANAGEMENT

(75) Inventors: Hardy Lee Crumby, Fernley; Ali Saffari; Richard Pennington, both of Reno, all of NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/577,556

(22) Filed: May 24, 2000

(51) Int. Cl.[7] ..... A63F 9/00

(52) U.S. Cl. ..... 463/42; 463/25; 463/26; 463/27; 273/138 A; 273/237

(58) Field of Search ..... 463/42, 26, 12, 463/27, 25, 18; 273/138 A, 237

(56) References Cited

U.S. PATENT DOCUMENTS 4,365,810 A * 12/1982 Richardson ..... 273/237
4,494,197 A * 1/1985 Troy et al. ..... 463/18
4,582,324 A * 4/1986 Koza et al. ..... 273/138 A
4,636,951 A * 1/1987 Harlick ..... 463/25
4,652,998 A * 3/1987 Koza et al. ..... 463/26
4,679,143 A * 7/1987 Hagiwara ..... 463/25
4,837,728 A * 6/1989 Barrie et al. ..... 463/27
5,042,809 A * 8/1991 Richardson ..... 273/138 A
5,324,035 A * 6/1994 Morris et al. ..... 273/138 A
5,855,515 A * 1/1999 Pease et al. ..... 463/27
5,876,283 A * 3/1999 Parra et al. ..... 463/12
6,183,366 B1 * 2/2001 Goldberg et al. ..... 463/42

* cited by examiner

*Primary Examiner*—Jessica Harrison
*Assistant Examiner*—Yveste Cherubin
(74) *Attorney, Agent, or Firm*—George H. Gerstman; Seyfarth Shaw

(57) ABSTRACT

In a gaming system, a central computer generates a plurality of game win-loss outcome stacks, each stack having at least one "win" (preferably, large-prize) outcome. Sub-stacks, from among the plurality of stacks, are transmitted to casino or other group controllers or computers, each casino controller being coupled to a plurality of gaming terminals. In response to placing a large-prize wager, in addition to normal, local game wager, a gaming terminal requests a large-prize outcome from the sub-stack which is stored in the casino controller. Whenever a casino controller's sub-stack is depleted, it requests a new sub-stack from the central computer. Preferably the central computer selects a new sub-stack for transmission according to a selection process which is weighted so as to maintain the ratio of winning outcomes to all outcomes in a predetermined range. When all sub-stacks of a given stack have been transmitted, the central computer generates a new stack to replace the depleted stack.

33 Claims, 4 Drawing Sheets

LARGE PRIZE CENTRAL MANAGEMENT

The present invention relates to a gaming system in which a "Large Prize" is made available to a player at a gaming terminal when an additional wager for that Large Prize is made by the player. The additional wager is in addition to the wager required to play the normal game on any particular gaming terminal. Preferably, the win/loss for that additional wager on that particular gaming station is determined based on information transmitted (directly or indirectly) from a central computer, or aggregate of ("suite" of) central computers, to the individual gaming stations.

BACKGROUND INFORMATION

A number of gaming systems include gaming stations or terminals, typically electronic terminals, although partially-mechanical terminals are also possible. Examples of electronic gaming terminals include electronic slot machines, electronic keno machines and the like. In a typical situation, a plurality of such machines are provided and a user activates or initiates play on one or more such machines by an action such as inserting a coin in a coin slot, currency in a bill verifier, inserting a credit card and/or smart card, making a selection by a push button, touch screen, etc., e.g. to make a wager. After play is initiated by a user, the gaming terminal determines whether the user has won or lost, and the terminal outputs this information and/or makes a payoff to the user.

One example of a situation in which win/loss of a large prize is centrally determined or influenced is a so-called progressive (multi-termninal) system. As used herein, a multi-terminal game or multi-terminal prize relates to a system in which a prize is funded from wagers placed at a plurality of different gaming terminals, typically with a central computer system keeping track of the contribution of wagers at various gaming terminals towards funding of the multi-terminal prize. In contrast, a local game or local prize refers to a system or prize in which there is no direct contribution toward a prize awarded at one gaming terminal from wagers placed at a different gaming terminal. In a typical progressive system, once a player has made at least a predetermined minimum wager on the normal, local game, the player is automatically eligible for a progressive prize. I.e. in typical progressive systems, the player does not place a separate wager towards the large prize. Typically, the player cannot place an additional wager on the progressive prize (over and above a wager placed on the normal gaming terminal (local) game), i.e. at least some portion of the wager which creates eligibility for the multi-terminal prize, goes towards the normal (local) game play (e.g. changing eligibility, odds or payout amounts on the local game). Accordingly, it would be advantageous to provide a gaming apparatus, system and/or method which could, if desired, be readily configured to allow a player to place an additional wager (or to choose to play the normal game without placing an additional wager) to achieve eligibility for a large multi-terminal prize, with no portion of the additional wager going towards (affecting eligibility, odds or payout size) play of the normal (local, single-terminal) game. It would be further advantageous to provide a Large Prize that all players on any gaming terminal of a multi-terminal system playing any game could compete for by placing an additional wager above and beyond the wager required to play that particular game.

Additionally, typical progressive systems have no way of assuring that for each large (multi-terminal) prize, there will be a pre-determined, preferably integral, number of losses (i.e. game plays which are eligible for a multi-terminal prize, but which do not result in a multi-terminal prize win. Accordingly it would be useful to provide a system, apparatus and method which assures a predetermined, preferably integral, number of losses for each multi-terminal prize win, preferably without regard to whether the losses occur before or after (usually both) the multi-terminal prize is won.

It is possible to devise gaming systems which provide a set of pre-determined but randomized, game results with only one (or with a known number) of such outcomes bearing winning outcomes. However, if players are aware that the known number of winning outcomes has been won, players may desist from further wagering, because all remaining outcomes are thought to be losing outcomes. Accordingly, it would be useful to provide a gaming system apparatus and method which provides a known. preferably integral, ration of wins to losses, without discouraging players from further, play, once a certain number of prizes has been won.

Furthermnore, a system which provides a fixed number of game outcomes with a single (or predetermined number of) winning outcome(s), can result in wide variations in players' chances of winning a prize, both as the non-winning outcomes are depleted and as the winning outcomes are depleted. For example, with a fixed number of outcomes and only a single winning outcome, a player's probability of winning drops to zero after the single prize has been won and until the remaining losing prizes have been depleted. Accordingly, it would be useful to provide a system which can achieve a predetermined number of losing outcomes for each winning outcome while still achieving substantial fairness to players by avoiding excessive or undue changes in players' chances of winning a prize as the games progress.

In a system in which information that determines game outcome has its source at a central computer (coupled, directly or indirectly, to a plurality of gaming terminals) provisions are needed for communicating the information from the central computer for use by or with the gaming terminals. When the system involves communication of a relatively large amount of information and/or communication to a relatively large number of gaming terminals, there is a risk that play at individual gaming terminals may be interrupted or slowed down while the terminals (or intermediate components) are awaiting receipt of the information. In some systems avoidance of such slow-downs could require an unduly large communications bandwidth, i.e. which is too costly to make a systerm-practical and/or which could prevent retrofitting existing gaming systems with a central game determination process. Accordingly, it would be useful to provide a system in which central outcome-determining information can be feasiblely communicated without undue costs, and substantially without interfering with desirably rapid game play at a gaming terminal, preferably in a manner which can be readily implemented on existing gaming systems (e.g. with existing communication capabilities).

In a centrally-controlled operation, the perception of the user can be important. It is believed that in many situations, the maximum entertainment value of such gaming is achieved when players or users subjectively believe that their manner of play and/or decision to play/not play at a particular time and/or at a particular station influences the win/loss outcome. For example, players often want to feel that they have a better chance of winning if they play selectively at those places or those times when they "feel lucky". It is believed that the entertainment value of gaming is reduced if the players believe that, at the time the game is played, the decision as to whether they win or lose has already been made, and/or is centrally made.

Accordingly, it would be advantageous to provide a system in which the win/loss decision at any individual electronic gaming terminal is determined by a central computer, and yet to increase entertainment value by providing players with a situation in which they perceive that their decision whether and when to play changes the win/loss outcome, or the probabilities thereof.

SUMMARY OF THE INVENTION

In one embodiment, a "Large Prize" system is composed of a central computer suite, casino local "Cluster Controller" computers, and gaming terminals. The Cluster Controllers are connected to the Central System, e.g. via modems and telephone lines for their communications. The Cluster Controllers are connected to gaming terminals, e.g. via a communications medium within the casino environment.

The player, at a gaming terminal, actuates buttons to indicate the desire to wager for, and participate in, the "Large Prize" draw. This participation is preferably optional and/or in addition to the normal play wager. The gaming terminal indicates, in its next communications with a Cluster Controller, that it needs a Large Prize draw entry. The Cluster Controller draws an entry from a Large Prize sub-stack, which it has received from the Central System. When the Cluster Controller exhausts its sub-stack of entries it requests a replacement from the Central System on its next communications with the Central System. The draw entry indicates whether the player has won or lost the Large Prize value.

The Central System maintains serialized stacks and sub-stacks. The stacks are composed of a finite set of entries with all but a predetermined number of the entries being a loss. One (or more) win entry is a large prize win amount. The Central Computer system builds and serializes the stacks and then firther divides the stacks into sub-stacks of entries. The sub-stacks are also serialized and their Cluster Controller ID assignment is archived (as it is determined).

The "Large Prize" central management application software provides sub-stack draws to the "Cluster Controllers" via phone lines and modem communications. The Central System maintains a set of stacks typically of a fixed quantity. Each stack is divided into sub-stacks, also of a finite size. The selection of a particular sub-stack to be sent to a Cluster Controller is determined by a random number generator that provides a selection number in the range of one to the size of the "Virtual Stack Selector" array of stack selector numbers. The next sub-stack drawn from a stack is determined by the random number generator.

In one aspect, in a gaming system, a central computer generates a plurality of game winloss outcome stacks, each stack having at least one "win" (preferably, large-prize) outcome. Substacks, from among the plurality of stacks, are transmitted to casino or other group controllers or computers, each casino controller being coupled to a plurality of gaming terminals. In response to placing a large-prize wager, in addition to normal, local game wager, a gaming terminal requests a large-prize outcome from the sub-stack which is stored in the casino controller. Whenever a casino controller's sub-stack is depleted, it requests a new sub-stack from the central computer. Preferably the central computer selects a newxsub-stack for transmission according to a selection process which is weighted so as to maintain the ratio of winning outcomes to all outcomes in a predetermined range. When all sub-stacks of a given stack have been transmitted, the central computer generates a new stack to replace the depleted stack.

DETAILED DESCRIPTION OF THE PREFERRED EMBODIMENTS

Figure 1:
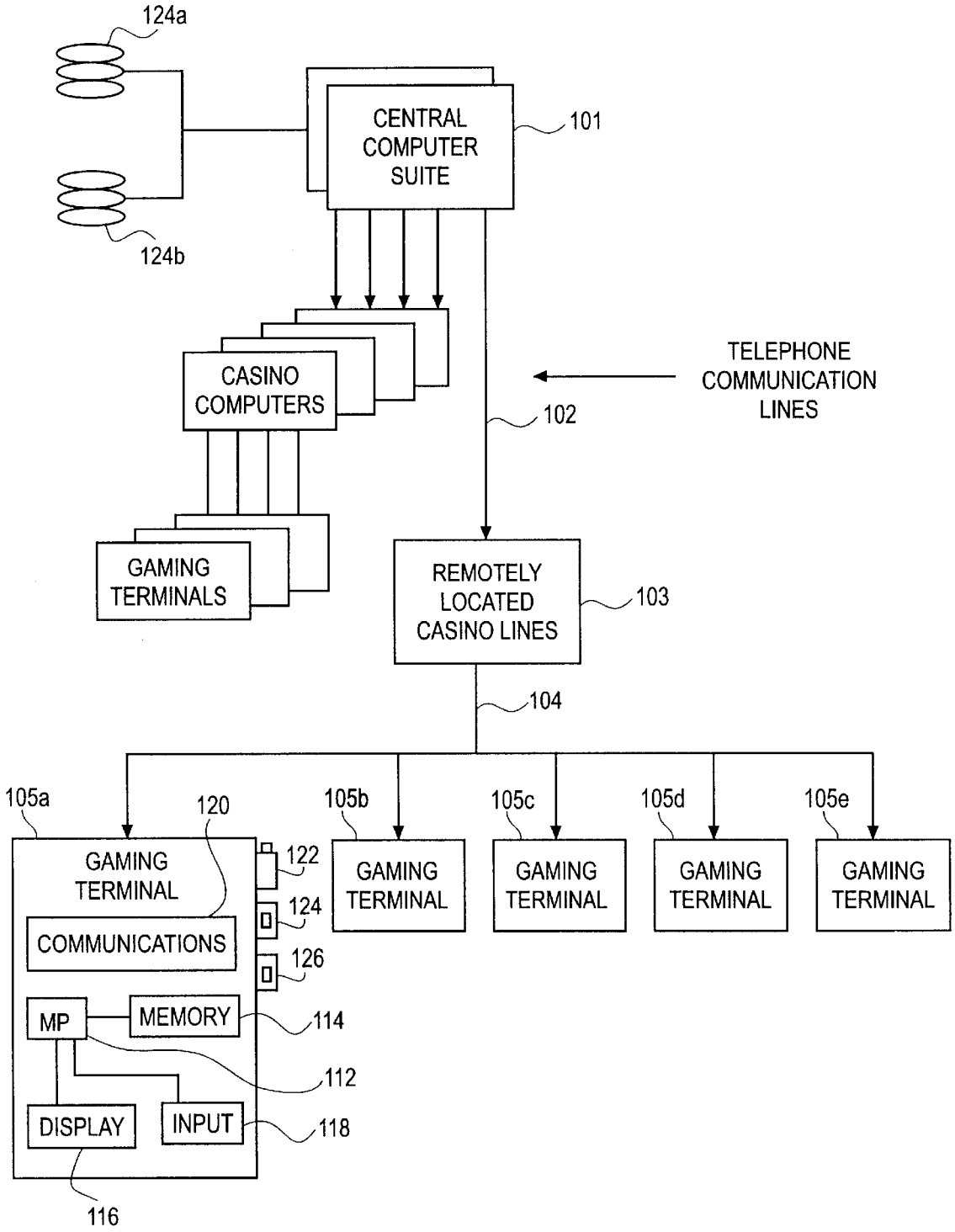
FIG. 1 is a block diagram of a gaming system according to one embodiment of the present invention.

As depicted in FIG. 1 according to one embodiment of the invention, each gaming terminal 105*a*, 105*b*, 105*c*, 105*d*, 105*e* is coupled via communication link 104 (e.g. LAN cable, fiber optic, wireless link, etc.) to a local casino computer 103. A number of types of gaming terminals can be used. In the depicted embodiment, each gaming terminal has a microprocessor 112 coupled to a memory 114, a display 116 or other output device, a touch screen, keypad, mouse or other input device 118 and a communications facility 118 such as a network card, a modem or the like. The terminal 105 also includes a device for permitting the user to use or activate the gaming terminal, such as by placing a wager, e.g. using coin slot 122 a credit card slot 126, a bill verifier 128, a smart card receiving slot, a keyboard for receiving an identifier codes, or other activation device. One or more buttons are provided by which a user may initiate and/or control play (which, if desired, may include touch-screen ("virtual") buttons, e.g. presented on the display screen, and/or a slot machine-style lever, not shown). The microprocessor operates in accordance with a program stored in memory 114 (or stored in a separate memory such as an EEPROM or flash memory). Although it is possible to provide for all terminals which are coupled to the local casino computer 103 to be configured to play the same type of game, preferably, the terminals 105*a*, 105*b*, 105*c* 105*d*, 105*e* and the programs therein, are configured so that different terminals may be used for playing different types of games, e.g. such that some terminals may be used for playing a slot machine-style game, others may be used for playing a poker-style game, others may be used for playing a keno-style game, and the like. In one embodiment, some or all terminals may be configured so that they may be used for playing any of a plurality of different games, as selected by casino personnel and/or as selected by the user. In the depicted embodiment, the memory of each terminal 105 stores paytable information, i.e. information which determines, for a given (local) game result, whether that result represents a winning result or a losing result and, if a winning result, the type and/or amount of the payout for such win. In one embodiment, any of the terminals and any games available within those gaming terminals may offer an additional "Large Prize" when an additional wager is made by the player. All players on all gaming terminals in the system compete for the same Large Prize when they place an additional wager.

The general manner of constructing a program to control a microprocessor so as to permit a user to play various games and output results, and the manner of constructing a program to further implement the present invention will be understood by those of skill in the art after understanding the present disclosure.

The communications link 104 can be any of a plurality of devices known to those of skill in the art for receiving data communications and placing it in a format suitable for transmission to the gaming terminal 105. In one embodiment, as described below, communications between the terminals 105 and the local casino computer 103 is two-way communication so that the communications device 104 also acts to transmit request and status information from the gaming terminal 105 to the local casino computer 103. The communication links 104 can be of various types, including coaxial cable, telephone cable, optical fiber, microwave communication links, infrared communication links, and the like.

In one embodiment of this invention the central computer suite 101 outputs to local casino computers 103, over a telephone line (or other) communications link 102, e.g. in response to a request, a pre-randomized and serialized sub-stack of Large Prize wager outcomes that is utilized to produce all requested Large Prize results by gaming terminals 105. The central computer suite 101 builds, serializes, and archives Large Prize stacks or lists of outcomes (e.g. as described below). Those of skill in the art will understand how to program computers and/or use computers or computer memories or other storage devices for generating lists (or generating information corresponding to lists or groups) and for storing lists or information corresponding to lists. A typical example stack size could be five million entries, with one entry being associated with a prize whose value is 4.5 million credits. The payback percent of this example would be 90 percent. Other sizes of stacks can be used as will be understood by those of skill in the art after understanding the present disclosure.

In at least one embodiment, the central computer suite 101 further divides the stacks into serialized substacks. Preferably the size of the sub-stacks is selected, taking into consideration the Central System to Cluster Controller communications medium and its speed. In general, the sub-stack should not be so large that, considering the speed (bandwidth) of the communications link, the downloading of a stack would substantially interfere with desirably rapid game play at a gaming terminal. A typical sub-stack size might, in one embodiment, be 1000 entries. The selection of which sub-stack to send to a local casino computer 103 over the telephone communications link 102 is determined by a program in the central computer suite that ensures that all entries in a stack are utilized and that the odds of winning remain approximately the same.

Figure 2:
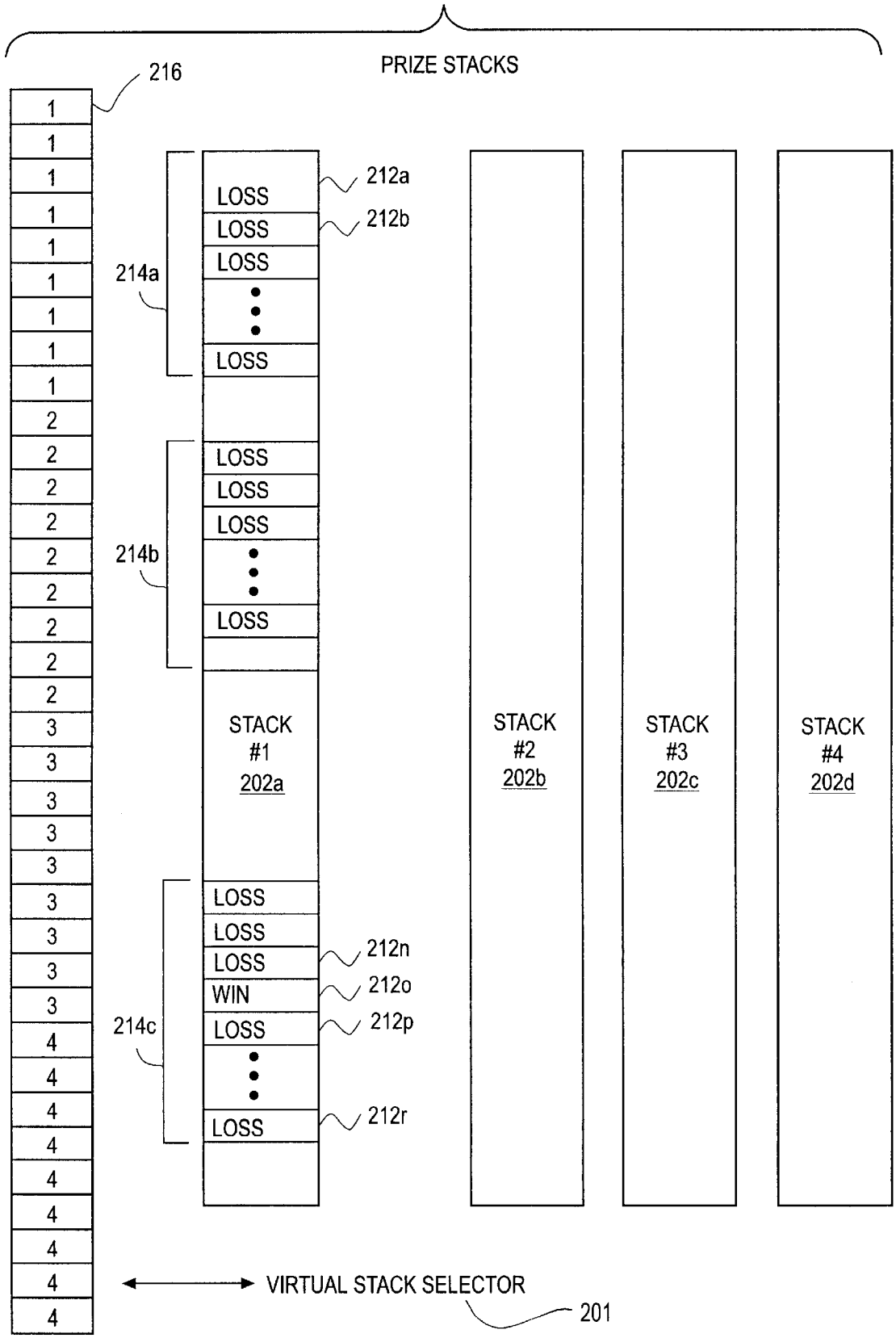
FIG. 2 depicts a typical set of prize stacks and the Virtual Stack Selector array according to an embodiment of the present invention.
Figure 3:
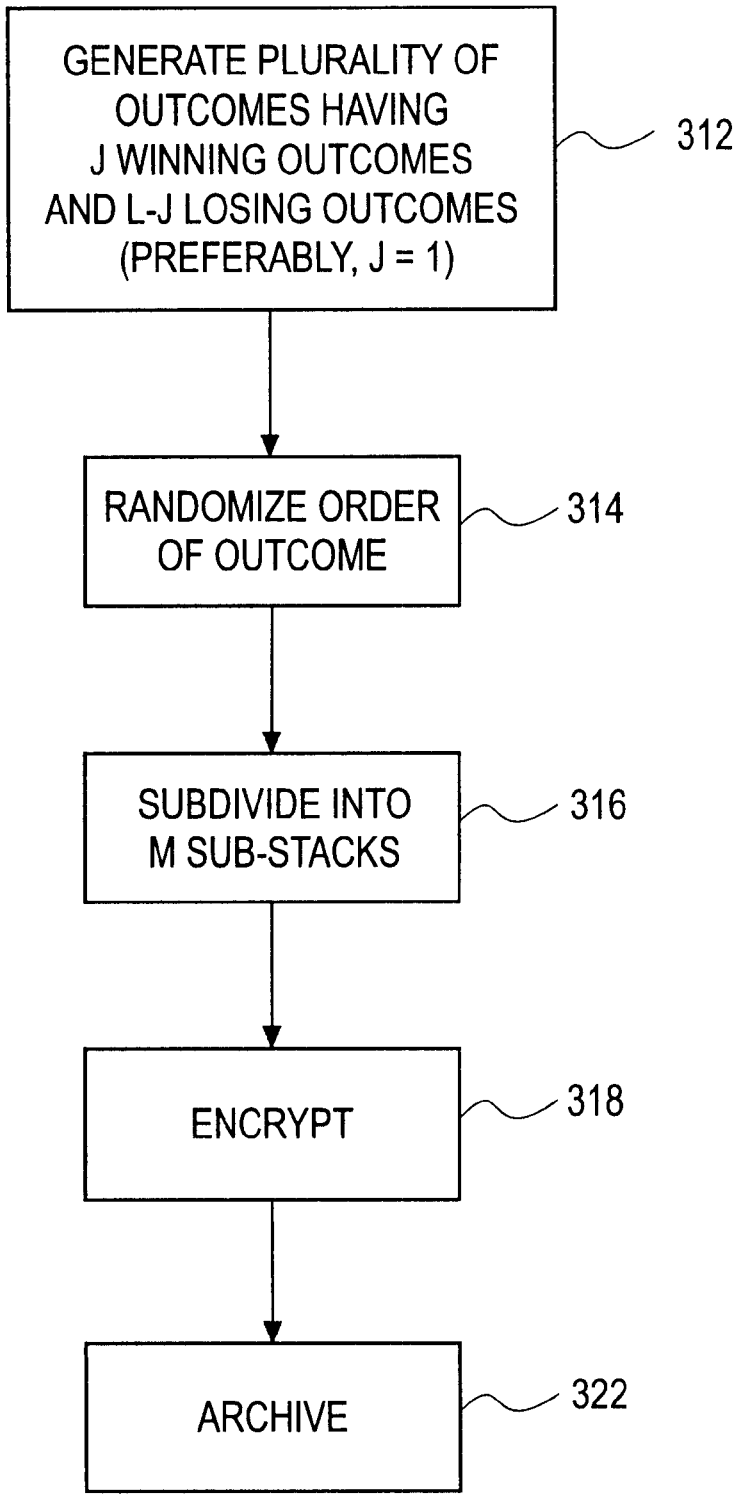
FIG. 3 is a flow chart of a stack and sub-stack generation procedure according to an embodiment of the present invention.

FIG. 2 depicts, in block diagram form, Large Prize outcome stacks and the virtual Stack Selector array, although other formats can be used, as will be apparent to those of skill in the art after understanding the present disclosure. In the depicted embodiment, the Large Prize stacks 202*a*, 202*b*, 202*c* and 202*d* are composed of a finite quantity of win/loss entries or outcomes 212*a–p*, with one win outcome 212*o* in each stack. Each stack is divided into serialized substacks 214*a*–214*c*, also of finite size. The stacks are randomized 314 before division 316 into sub-stacks. The stacks, and their sub-stacks, are then encrypted 318 and archived 322 on multiple disk drives 124*a,b* for secure, redundant storage. Information indicating which sub-stack is sent to which local casino computer, as well as when (as described below), is also archived on disk in an encrypted manner. In one embodiment, the sub-stack data is encrypted by the central computer before transmitting over the telephone communication link 102 and decrypted in the local casino computer 103 according to decryption keys which may be downloaded, from time to time, or otherwise changed. Encryption assists in preventing cheating.

In one embodiment, the Virtual Stack Selector array 201 is of a size determined by the Stack Selector programming as well as the value ofthe stack pointers within that array. For example, when the system is first initialized, and when, as shown in the embodiment depicted in FIG. 2, there are, e.g. four stacks, each entry in the virtual stack selector 201 will contain a pointer 216 pointing to one of the stacks 202 and/or pointing to one of the sub-stacks 214*a,b,c*, within that stack 202*a*. For example, in the illustration of FIG. 2, the stack selector 201 has equal numbers of pointers pointing to each of the four stacks. Thus, in this situation, the odds of selecting any one of the four stacks are equal. If (as described below) it is desired to provide relatively higher odds of selecting one of the stacks, this can be accomplished by providing relatively more pointers pointing to that stack. For example, if it was desired to provide odds of selecting the fourth stack which were twice as high as the odds of selecting any of the other stacks, in the embodiment of FIG. 2, this could be accomplished by modifying the selector stack depicted in FIG. 2 to include 9 additional pointers pointing to stack number 4.

Figure 4:
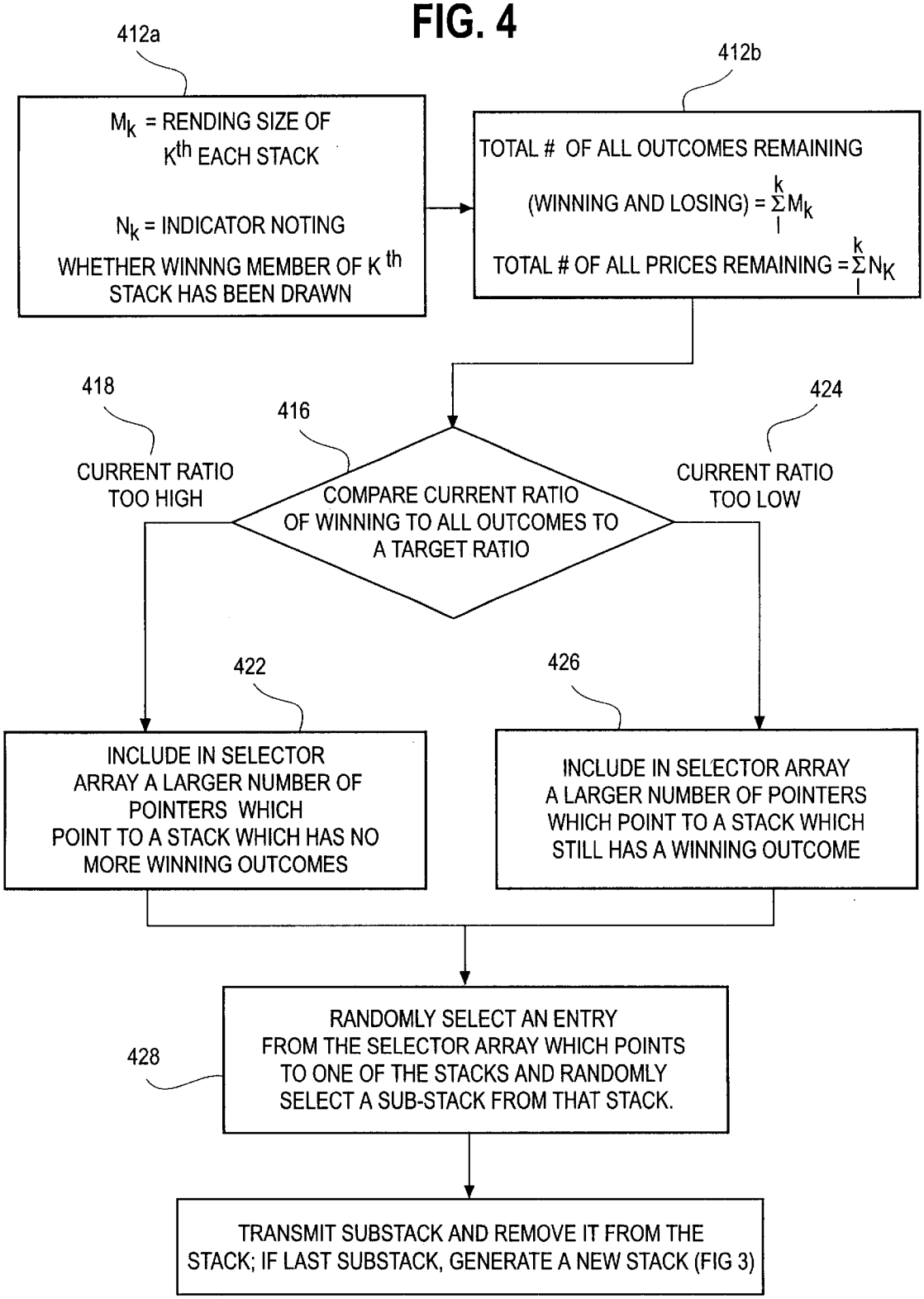
FIG. 4 is a flow chart of stack/substack selection and transmission according to an embodiment of the present invention.

In the embodiment depicted in FIG. 4, the procedure will compare the current ratio of winning outcomes to the total number of all winning outcomes to a target ratio 416. The process builds the Virtual Stack Selector array 201 based on which stacks still have a winning outcome and which do not. The process preferably also manages the odds of winning to maintain a preset value. In one embodiment, after the process has built the Virtual Stack Selector array, a random number generator is run to develop a number in the range of one to the maximum number of stack pointers in the (current) Virtual Stack Selector array. The results of the random number generator will determine which stack pointer, and therefore which stack, will be utilized to select the next sub-stack to send to a local casino computer. One purpose of the Virtual Stack Selector array is to ensure that all stack entries are drawn and to ensure a reasonable chance of winning to all players.

The size of the Virtual Stack Selector array, and its stack selector values are determined by a procedure executed each time a sub-stack is sent to a Cluster Controller. The algorithm has, as input information, the remaining size of each stack and whether its single winning entry has been drawn 412*a,b*. The size of the Virtual Stack Selector and its stack selector values are weighted to ensure that all entries are drawn and that the odds of winning remain approximately the same for the players. The stack selection algorithm will weight in favor of stacks whose winner is already drawn 422 if the ratio of total remaining winners to total remaining entries is high, compared to the preset target ratio 418. But the algorithm will weight in favor of stacks whose winner has not been drawn 426 if the current ratio is less than the target ratio.

After the selector array 201 has been formed, an entry from the selector array is chosen which, thus, points to one of the stacks, and a randomly selected sub-stack, from that stack, is chosen 428. The chosen sub-stack is transmitted to the casino computer 103 and, when a stack is exhausted (i.e. if the last sub-stack has been transmitted) a new stack is generated, i.e. and the depleted stack is replaced by a new stack (preferably whose entries have been pre-randomized).

If a player makes an additional wager at a gaming terminal 103, the gaming terminal will send a communication (either in an interrupt fashion or a polling fashion) to the casino computer 103 indicating that it needs a large prize (multi-terminal) outcome or entry. The cluster controller 103 will select one of the outcomes or entries from the sub-stack which has been sent to it from the central computer 101. The cluster controller 103 then sends that outcome to the requesting gaming terminal 105 and the gaming terminal will notify the player (or provide a payout) if the outcome which it receives from the cluster controller is a winning outcome. If the outcome which the cluster controller sends to a gaming terminal is the last outcome in its current sub-stack, the cluster controller 103 will send a communication to the central computer 101 indicating that it requires a new sub-stack and the cluster controller will execute a sub-stack selection procedure (e.g. as illustrated in FIG. 4).

The system, in at least one embodiment, allows a player to choose whether to place an additional wager and preferably in a fashion such that the choice made by the player with respect to the additional wager has no effect on the eligibility, odds or prize magnitude (or other gaming aspects) of the local (single-terminal) game. The present invention, as described, can be implemented by a procedure involving the generation of game outcome groups or stacks, with each stack having a predetermined total size and having a predetermined number (including, if desired, one) of winning outcomes in each stack. In this way, the ratio of winning outcomes to total outcomes can always be a predetermined integral relation or a ratio. By providing a system which has a plurality of stacks, each with at least one prize, and with depleted stacks being replaced by new prize-bearing stacks, there will always be at least some prizes available for players and thus it is unlikely players will perceive, or conclude, that, after a large prize has been won, additional wagering on the large prize is fruitless. In at least one embodiment, by providing a selection array which is adjusted to provide weighting, the odds of selecting prize-bearing substacks, for transmission, can be adjusted so as to provide odds which are maintained near a target, or within a target range.

In light of the above description, a number of advantages in the present invention can been seen. The invention provides for central generation of large prize win/loss information for a plurality of gaming terminals. Using the present invention the large prize may exceed in value any such prize that could be feasiblely provided within a single gaming terminal. The Stack Selector procedure ensures against the possibility that players might be discouraged from further play, after the Large Prize is won. The present invention can be implemented to assist in maintaining relatively stable (average) odds of winning, for the players.

A number of variations and modifications of the invention can be used. It is possible to use some features of the invention without using others. For example, it is possible to implement the invention without including a system which has a plurality of different cluster controllers (i.e. it is possible to use only a single cluster controller). Although providing one or more cluster controllers is believed to promote efficiency of communication, especially where a large number of gaming terminals are coupled to a central computer, it is at least theoretically possible to provide for direct communication between a plurality of gaming terminals and a central computer. Although the invention describes communication over local area networks, telephone lines, and the like, it is also possible to use other types of communication links including Internet communication, satellite communication, private communication networks and the like. Although certain embodiments include steps of providing a list, randomizing the list and then making selections, it is also possible to provide lists which are not separately randomized and, instead, use a procedure which provides for random selection from a (possibly ordered) list or group. Although it is at least theoretically possible to provide for communication of an entire stack (e.g. to a cluster controller, it is believed one of the benefits of communicating only portions of any stack (i.e. substacks) is the avoidance of the need for transmitting relatively large amounts of data at a single time, thus spreading the data communication requirements over time and reducing the bandwidth which is needed to accommodate the necessary data transmission while avoiding interrupting or slowing down game play (e.g. while the cluster controller awaits new data). Although embodiments are described in which large-prize eligibility is achieved in response to an additional wager, i.e. a wager which does not affect play of the local (non-multiterminal) game, it is also possible to implement at least some features of the present invention when eligibility for the large prize is in response to some or all of a normal game (local game) wager and/or in response to a wager which affects play or prizes in the local game. As one example, a game can be constructed, according to an embodiment of the present invention, in which a gaming terminal having a maximum bet of $3.00 included potentials for wagering $1.00, $2.00 and $3.00 but in which the paytable (defining local game prizes) was based on $1.00, $2.00 and $2.75 wagers, with the extra $0.25 wager on the third dollar constituting the large prize or multi-terminal prize wager. Thus, it is possible, if desired, to construct a game in which, although there is an additional wager devoted exclusively for a multi-terminal prize, the wager can only be placed in conjunction with placing at least part of a local game wager. One potential advantage of such an arrangement is that it presents players with a familiar wagering paradigm, including relatively familiar wager amounts without it being immediately apparent that a portion of a wager is being devoted exclusively to the multi-terminal prize. Many players are believed to be accustomed to at least the appearance that wagers are being placed only on local games and that eligibility for a multi-terminal prize is provide "free" (at least if a minimum local terminal wager is placed). Although some embodiments have been described in which each stack contains a single winning outcome, it is also possible to provide configurations with stacks having two or more winning outcomes. Preferably some of the gaming terminals may be configured for playing games different from those of other terminals. For example, some terminals may be configured as slot machine-type games while others may be configured as poker-type games. Some gaming terminals may be configured to simulate three-reel slot machines while others may be configured to simulate five-reel machines each with hundreds or thousands or reel positions (so-called "virtual reel" machines).

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease andor reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A gaming method comprising:

providing a plurality of gaming terminals at least indirectly coupled to a central computer, said plurality of gaming terminals including at least a first gaming terminal configured for playing a local game;

generating, in said central computer, at least a first and a second plurality of game outcomes, each of said first and second plurality of outcomes including at least one winning outcome;

using said central computer to select one of said first and second pluralities of outcomes, to provide a selected plurality of said outcomes, wherein said step of selecting one of said pluralities of gaming outcomes comprises using a weighted selection process configured to provide odds for selecting a plurality of game outcomes which maintain average odds of players winning one of said plurality of winning outcomes within a predetermined target range;

transmitting at least a portion of said selected plurality of said outcomes for storage in at least a first storage device remote from said central computer, receiving a first wager at said first gaming terminal providing eligibility for playing said local game;

receiving an additional wager, at said first gaming terminal;

obtaining at least one gaming outcome from said portion stored at said storage device, in response to said additional wager to provide a first gaming terminal outcome; and outputting, from said gaming terminal, an indication of a prize win only if said first gaming terminal outcome is a winning outcome.

2. A method claimed in claim 1 wherein each of said plurality of gaming outcomes is subdivided, in said central computer, into subpluralities of gaming outcomes and wherein said portion of the plurality of said outcomes comprises one of said subpluralities.

3. A method as claimed in claim 1 wherein said storage device is coupled to a second computer, different from said central computer, coupled to at least some of said plurality of gaming terminals.

4. A method as claimed in claim 1 further comprising replacing any of said plurality of gaming outcomes with a new plurality of gaining outcomes whenever all gaming outcomes in a plurality of gaming outcomes has been transmitted.

5. A method for using a gaming system comprising:

providing a central computer;

coupling said central computer to at least one local casino computer, having a microprocessor configured for providing game outcome draws to gaming terminals;

coupling said local casino computer to at least a first gaming terminal having a terminal processor configured for playing a game;

transmitting, upon request from a specific gaming terminal, a Large Prize game outcome addressed to said gaming terminal;

initiating play at a first of said plurality of gaming terminals by requesting a first additional Large Prize outcome for any game in progress of play of said first gaming terminal, in response to a user action occurring at a first time, wherein said first Large Prize outcome is based on a first selection from a sub-stack of such Large Prize outcomes made at a first-time within a local casino computer requested and received at said first gaming terminal from said local casino computer at said first time;

initiating play at a second of said plurality of gaming terminals by requesting a second additional Large Prize outcome for said game of said second gaming terminal, in response to a user action occurring at a second time, wherein the second Large Prize outcome is based on a second selection from a sub-stack of said Large Prize outcomes made at a second time within a local casino computer requested and received at said second gaming terminal from said local casino computer at said second time;

further in which stacks of such Large Prize outcomes are stored and subdivided into a plurality of sub-stacks of said Large Prize outcomes, each stack initially having at least one winning Large Prize outcome in at least one of its sub-stacks, said central computer being programmed to note when said winning Large Prize outcome is removed from a stack, and further programmed to select and transmit sub-stacks as requested by a local casino computer in a nonrandom manner, whereby the odds that a player can obtain a winning outcome remain roughly constant;

wherein said terminal processors are configured such that when said first and second terminals are configured for playing any game type when game play is initiated and an additional wager for a Large Prize outcome has been placed by a player on at least of said first and second gaming terminals and when said first and second game Large Prize outcomes are received by said first and second gaming terminals, the players of the said first and second terminals will be informed of win/loss results.

6. A method as claimed in claim 5 wherein said central computer is coupled to a plurality of local casino computers.

7. A method as claimed in claim 5 wherein said local casino computer is coupled to a plurality of local casino gaming terminals.

8. A method as claimed in claim 7 wherein games of at least two of said plurality of gaming terminals are different.

9. A method as claimed in claim 5 wherein said transmitting of Large Prize outcomes occurs upon request of said gaming terminal.

10. A method as claimed in claim 5 further comprising selecting in said central computer by a process utilizing a random number system, a Large Prize outcome sub-stack, and further comprising transmitting said Large Prize outcome sub-stack upon request of said local casino computer to said local casino computer.

11. A method as claimed in claim 5 wherein said transmitting Large Prize outcomes includes transmitting to specifically addressed requesting gaming terminals.

12. A method as claimed in claim 5 wherein said step of transmitting including transmitting over a communication link selected from among coaxial, telephone cable, fiber optics, microwave links, infrared links, and radio communication links.

13. A method as claimed in claim 5 wherein said game of at least one of said plurality of gaming terminals uses first and second Large Prize outcomes based on first and second Large Prize outcomes received, after requesting said outcomes, at said gaming terminal at first and second different times.

14. A method as claimed in claim 5 wherein said Large Prize outcome sub-stacks provided by said central computer to said local casino computers and are created, serialized, encrypted, and archived by said central computer and distributed, upon request, to said local casino computer wherein the selection of which sub-stack to distribute is made by a process performed within said central computer.

15. A method as claimed in claim 5 wherein said local casino computer distributes Large Prize outcome entries from said sub-stack to gaming terminals upon request with removal of distributed Large Prize outcomes from said sub-stack, until said sub-stack is exhausted.

16. A method as claimed in claim 5 further comprising detecting loss of a communication link between said local casino computer and said gaming terminal.

17. A method as claimed in claim 16 further comprising suspending Large Prize wagering in response to said step of detecting.

18. A method as claimed in claim 16 further comprising returning or crediting Large Prize wagers placed but not yet played in response to said detecting.

19. Apparatus for a gaming system comprising:

a central computer;

a plurality of local casino computers;

a plurality of gaming terminals coupled to said local casino computer by communication links, each terminal having a terminal processor configured for playing a game, said central computer being programmed to store stacks of Large Prize outcomes and to divide said stacks into a plurality of sub-stacks of said Large Prize outcomes, each stack initially having at least one winning Large Prize outcome in at least one of its sub-stacks;

said central computer being programmed to transmit, upon request, a sub-stack of Large Prize outcomes from said central computer, addressed to a specific requesting local casino computer, said central computer being also programmed to note when a winning Large Prize outcome is removed from a stack and programmed to select and transmit said sub-stacks as requested in a non-random manner in which the various stacks from which sub-stacks are selected have varying odds of selection, whereby the odds that a player can obtain a winning outcome remain roughly constant;

said local casino computer being programmed to transmit, upon request, a Large Prize outcome from said local casino computer addressed to a specific to a specific requesting gaming terminal;

said terminal processor ofeach gaming processor ofeach gaming terminal being programmed to request a Large Prize outcome from said local casino computer in response to a user action, and to display on the said gaming terminal the results of the Large Prize outcome.

20. Apparatus for using a gaming system comprising:

a central computer;

a plurality of local casino computers;

a plurality of gaming terminals, each terminal having a terminal processor configured for playing a game;

means for coupling said central computer to said plurality of said local casino computers;

means for coupling said local casino computer to said plurality of said gaming terminals, said central computer being programmed to store stacks of Large Prize outcomes and to divide said stacks into a plurality of sub-stacks of said Large Prize outcomes, each stack initially having at least one winning Large Prize outcome in at least one of its sub-stacks, said central computer being also programmed to note when said winning Large Prize outcome is removed from a stack and programmed to select and transmit said sub-stacks as requested in a non-random manner, whereby the odds that a selected sub-stack contains a winning outcome remain roughly constant;

means for transmitting a sub-stack of Large Prize outcomes from said central computer to any specific local casino computer of said plurality of local casino computers; and means for transmitting a Large Prize outcome from any particular one of said local casino computers to any specific gaming terminal of said plurality of gaming terminals.

21. The apparatus of claim 20 wherein said means for transmitting a requested Large Prize outcome sub-stack includes a processor in said central computer and a stored program.

22. The apparatus of claim 20 wherein said means for transmitting a requested Large Prize outcome includes a processor in said local casino computer and a stored program.

23. Apparatus as claimed in claim 20 wherein said means in said first of said plurality of gaming terminals includes a processor and a stored program.

24. A method for wagering for a Large Prize outcome in any style of game comprising:

providing a central computer;

providing a plurality of local casino computers;

providing a plurality of electronic gaming terminals, each of said plurality of electronic terminals including a microprocessor and a memory wherein said memory stores a program for playing any style game, with user input for additional Large Prize wagering and displaying of results, said central computer being programmed to store stacks of Large Prize outcomes and to divide said stacks into a plurality of sub-stacks of said Large Prize outcomes, each stack initially having at least one winning Large Prize outcome in at least one of its sub-stacks;

transmitting, upon request from a first electronic terminal of said plurality of electronic terminals, a Large Prize outcome from said local casino computer to a first requesting electronic gaming terminal;

noting when said winning Large Prize outcome is removed from a stack, and selecting the various sub-stacks as requested by a local casino computer in a non-random manner, whereby the odds that a selected sub-stack contains a winning outcome remain roughly constant;

receiving a first user game play input at said first electronic terminal;

receiving an indication of a Large Prize wager from said user in said first electronic terminal;

determining, in said first electronic gaming terminal, whether the communication link between said first electronic terminal and said local casino computer is operable;

when said communication link is operable, requesting and receiving a Large Prize outcome from said local casino computer after a step of determining whether said communication link is operable;

displaying, on a display screen coupled to said electronic terminal, win/loss results of said Large Prize wager in addition to any results of game play for a particular type of game being played on said gaming terminal.

25. The gaming method of claim 1 further comprising using a random number system to obtain said selected plurality of said outcomes.

26. The method of claim 19 in which said process performed within said central computer comprises a random number-based selection system.

27. The apparatus of claim 19 in which said central computer is programmed to transmit, upon request, a sub-stack selected by a random number-based selection system.

28. The apparatus of claim 20 in which the means for transmitting a sub-stack of Large Prize outcomes from the central computer further comprises a random number-base system for selecting said sub-stack.

29. The method of claim 24 further comprising the step of creating in said central computerapluralityofstacks of Large Prize outcomes and, upon request from any of the local casino computers, using a random number system to obtain a selected sub-stack of Large Prize outcomes, selected out of one of said stacks, and transmitting said selected sub-stack to said one local casino computer for use by said one local casino computer as a supply of Large Prize outcomes for said plurality of electronic terminals.

30. A gaming method comprising:

providing a plurality of gaming terminals at least indirectly coupled to a central computer, said plurality of gaming terminals including a least a first gaming terminal configured for playing a local game;

providing a plurality of stacks of game outcomes, each said stack being divided into a plurality of sub-stacks of outcomes, each stack initially having at least one winning outcome in at least one of its sub-stacks;

transferring a sub-stack to a local casino computer which connects and controls a plurality of said gaming terminals;

noting when a winning Large Prize outcome is removed from a stack; and selecting a sub-stack from one of the stacks in a non-random manner whereby the odds that a player can obtain a winning outcome remain roughly constant.

31. The method of claim 30 including the step of assigning varying odds of selection to each stack depending on whether a winning outcome remains in the stack or not, and thereafter selecting one stack for removal of a sub-stack by random selection in accordance with the assigned odds for each stack.

32. Apparatus for using a gaming system comprising:

a central computer, a plurality of local casino computers, a plurality of gaming terminals, several of said terminals each connected to a local casino computer; said central computer being programmed to store stacks of Large Prize gaming outcomes and to divide said stacks into a plurality of sub-stacks of said Large Prize outcomes, each stack initially having at least one winning Large Prize outcome and in at least one of said sub-stacks, said central computer being also programmed to send said sub-stacks upon request to local casino computers, said central computer being also programed to note when said winning Large Prize outcome is removed from a stack, and tbrther programmed to select sub-stacks from particular, selected individual stacks in a non-random manner, whereby the odds of a player obtaining a winning outcome remain roughly constant.

33. The apparatus of claim 32 in which the program to select an individual stack from which a sub-stack is to be withdrawn uses a system of assigning varying odds of selection to said stacks depending on whether a winning outcome remains in the stack or not, followed by a generally random selection process of selecting said stack in accordance with the assigned odds.

* * * * *